US005564702A

United States Patent [19]

Meffert

[11] Patent Number: 5,564,702

[45] Date of Patent: Oct. 15, 1996

[54] INTERACTIVE SPHERICAL GAME HAVING LIGHTS AND SWITCHES

[76] Inventor: Uwe Meffert, 28A, Tower 7, South Horizons, AP Lei Chau, Aberdeen, Hong Kong

[21] Appl. No.: 448,232

[22] Filed: May 23, 1995

[30] Foreign Application Priority Data

Mar. 27, 1995 [GB] United Kingdom ..... 9506209

[51] Int. Cl.[6] ..... A63F 9/06

[52] U.S. Cl. ..... 273/153 R; 273/58 G; 273/460

[58] Field of Search ..... 273/138 A, 237, 273/153 R, 156, 157 R, 85 G, 58 G, 433, 454, 455, 460

[56] References Cited

U.S. PATENT DOCUMENTS 2,870,549 1/1959 J. F. Craine .
4,169,592 10/1979 Hall .
4,240,638 12/1980 Morrison et al. .
4,863,172 9/1989 Rosenwinkel et al. .
5,215,311 6/1993 Schuller .
5,286,037 2/1994 Ghaly .
5,417,425 5/1995 Blumberg et al. .

FOREIGN PATENT DOCUMENTS 1202604 1/1986 U.S.S.R. .
WO95/27542 10/1995 WIPO .

*Primary Examiner*—William M. Pierce
*Attorney, Agent, or Firm*—Spencer & Frank

[57] ABSTRACT

A puzzle having a substantially spherical housing comprising a plurality of lights disposed over the surface thereof, a plurality of switches operable by a user, and a control device operatively connected to the switches and to the lights for switching on and off the lights in response to operation of a respective switch.

10 Claims, 3 Drawing Sheets

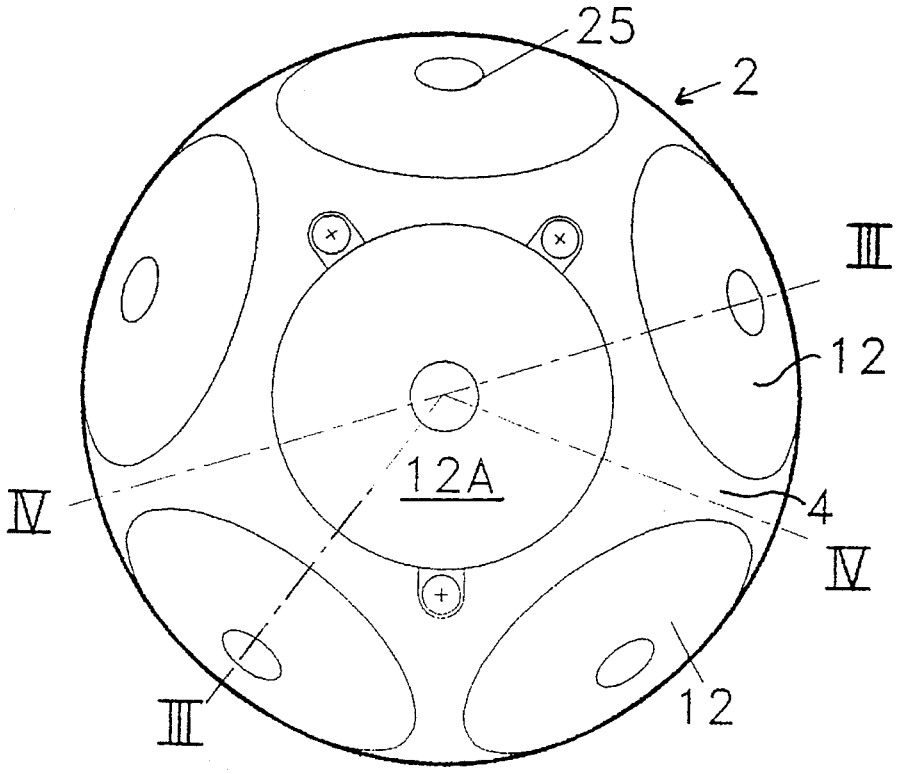
-FIG 1-
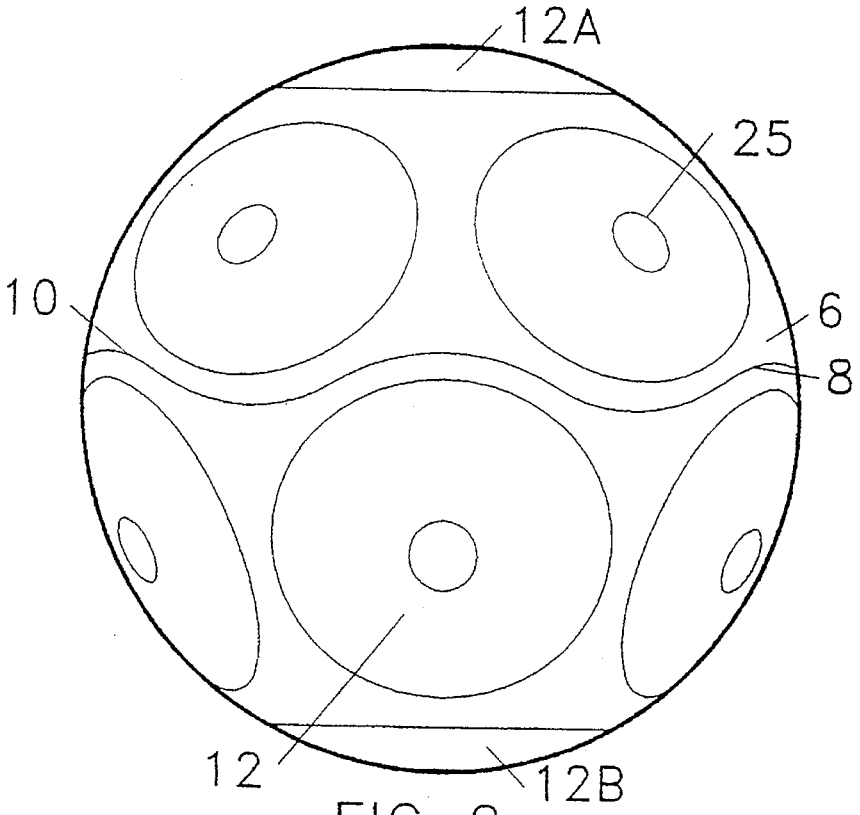
-FIG 2-

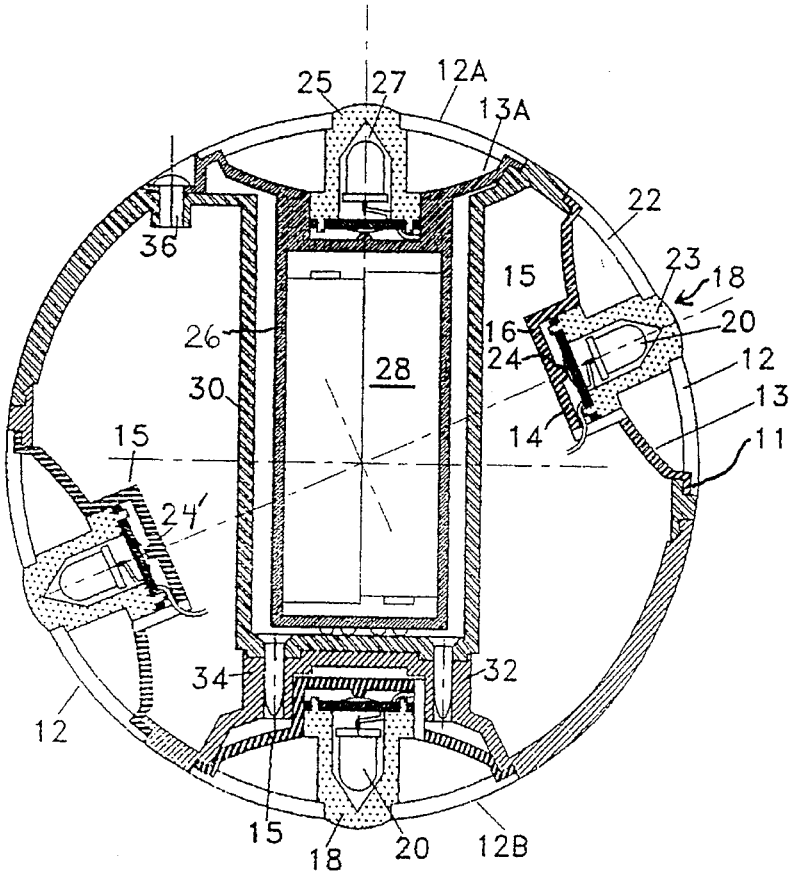
-FIG 3-
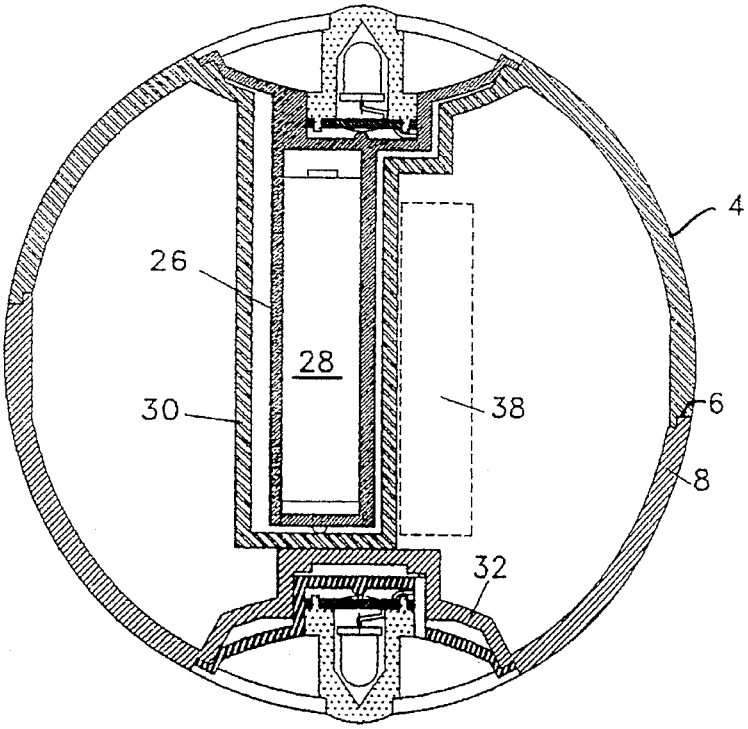
-FIG 4-

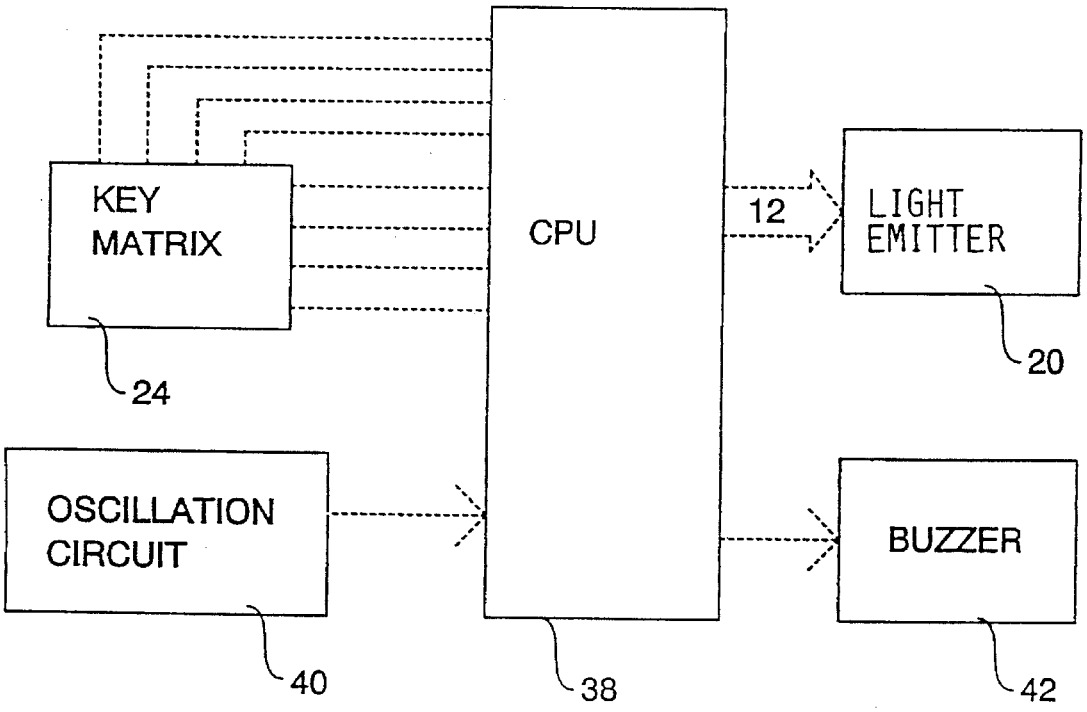
- Fig 5 -

INTERACTIVE SPHERICAL GAME HAVING LIGHTS AND SWITCHES

CROSS-REFERENCE TO RELATED APPLICATIONS

This application claims the priority of application Ser. No. 9506209.7 filed in the United Kingdom on Mar. 27, 1995, which is incorporated herein by reference.

BACKGROUND OF THE INVENTION

The present invention relates to a puzzle, and in particular to a light puzzle which incorporates a plurality of lights and a plurality of switches, in which activation of a switch causes the light pattern to change in a manner dictated by electronic control means, whereby an interactive game is provided.

Existing puzzles of this general type include a two-dimensional array of lights, where a user can turn on or off individual lights and in response to the switching action, the processor turns on and/or off a further pattern of lights. These puzzles suffer the disadvantage that, because they are two-dimensional, there is always an "edge" to the light array at which a different scheme or set of rules to solving the puzzle will apply.

SUMMARY OF THE INVENTION

It is an object of the present invention to provide a puzzle comprising a substantially spherical housing. A plurality of lights are disposed over a surface of the housing. A plurality of switches operable by a user are disposed over the surface of the housing. Control means are operatively connected to the switches and to the lights for switching on and off the lights in response to operation of a respective switch.

Arranging the lights on the surface of a sphere provides a particularly challenging puzzle where a light pattern game can be played over the entire sphere surface.

Preferably, the puzzle has twelve lights disposed evenly over the sphere surface.

In the preferred embodiment, the lights comprise light emitting elements, and the switches include regions which constitute buttons which are depressed by a user to operate the switch and are at least in part formed of light-translucent material, with the light emitting elements being disposed beneath respective buttons. Each switch includes a generally cylindrical light-translucent actuator, an upper surface thereof constituting a button and lying generally coincident with the surface of the sphere, at least a lower region thereof being seated in a cylindrical socket such that a degree of relative movement is allowed. In this way, the user is actually depressing the lights or part of the lights to operate the game.

A contact switch is disposed between the movable actuator and the cylindrical socket which is actuated as the button is depressed. The light emitting element is preferably a light emitting diode. Audible indicating means may be provided which are activated in response to a signal from the control means. The control means is preferably a microprocessor programmed to operate the lights to provide a game.

The invention will be described below in greater detail in connection with an embodiment thereof that is illustrated in the drawing figures.

BRIEF DESCRIPTION OF THE DRAWINGS

FIG. 1 is a view of the puzzle from above.

FIG. 2 is a side view of the puzzle.

FIG. 3 is a schematic cross-sectional view taken along the line III—III of FIG. 1.

FIG. 4 is a schematic cross-sectional view taken along the line IV—IV of FIG. 1.

FIG. 5 illustrates diagrammatically electronic circuitry employed in the puzzle.

DETAILED DESCRIPTION OF THE INVENTION

Referring to FIGS. 1 and 2, a puzzle 2 is illustrated. The puzzle 2 comprises a spherical shell 4, which in the Figures is shown slightly flattened in order to allow more of the surface of the puzzle to be seen. The shell 4 comprises upper and lower shell halves 6, 8 formed preferably of plastics material, which are permanently joined along line 10 by adhesive, or by a welding process.

Distributed over the surface of the puzzle are a plurality of lights 12, 12A, 12B. The illustrated example shows twelve lights, which is a convenient number which can be evenly distributed over the surface of the sphere, but other numbers of lights could be employed. For example, twenty is the next number which geometrically can be evenly distributed. Alternatively, there could be minor variations in spacing between the lights, in which case other numbers of lights may be employed. In the illustrated embodiment employing twelve lights, ten of these are identical and are indicated by the numeral 12 whilst the remaining two, indicated 12A and 12B include certain structural differences as discussed below.

Referring also to FIG. 3, each light 12 includes a concave reflector element 13 which sits in a circular aperture 11 in the shell 4 and which is highly reflective on its concave surface. A base region 14 of the reflector element 13 defines a cylindrical socket 15. Seated in this socket 15 is a generally cylindrical switch actuator 18. The base of the actuator 18 supports a circuit board 16 which carries a light emitter 20, which is preferably an LED, but might also be a conventional filament bulb. A partly-spherical lens 22 overlies the reflector 13 and includes a circular aperture 23 through which an upper region of the actuator 18 protrudes. This upper region constitutes a button 25, which is depressed by a user during play of the puzzle to operate a switch, as described further below. The actuator 18 is formed of a clear plastics material, and includes an inner conical surface 27 which may have a roughened light-diffusing surface. The lens 22 may be clear or may have a slightly frosted or molded surface in order to diffuse the light from the light emitter 20. The printed circuit board 16 carries on its lower radially-inwardly directed surface a tap switch or dome switch 24 which abuts a protrusion 24' on the radially-outwardly directed basal surface of the socket 15. The actuator 18 is movably held by the socket 15, so that the actuator can be depressed by a user relative to the shell 4 and lens 22, thus activating the switch 24. Only a small degree of movement is required.

As referred to above, the light 12A has a different construction from lights 12. As can be seen in FIG. 3 and 4, the actuator 18, light emitter 20, printed circuit board 16 and switch 24 are of identical construction as those parts of lights 12 with similar reference numbers; however, the reflector 13A is integrally formed with a battery housing 26 which houses a pair of AAA-sized batteries 28. The housing 26 sits within a chamber 30 which is integrally formed with the upper shell half 6. A lower region of the chamber 30 is connected to an upper or inward end of a support 32 which is integral with the lower shell half 8, using screws 34.

The upper reflector 13A is removably mounted in its reflector seat using screws 36.

FIG. 5 shows schematically the circuitry employed in the puzzle. This includes a central processing unit (CPU) 38 which may be a Samsung type, such as a KS 57C 0002 microprocessor, or may be a similar Sanyo or Soki type. The switches 24 are each operatively connected to the central processing unit 38, these constituting a "key matrix input" to the CPU. An oscillation circuit 40 provides clock control for the CPU 38. The outputs from the CPU go to the light emitters 20, and to a buzzer or loudspeaker 42 which is used to give an audible indication to a user, for example to give an indication of activation of individual switches or to give an indication that the puzzle has been switched on, or that the puzzle has been solved. The CPU 38, oscillation circuit 40 and buzzer or loudspeaker 42 are disposed inside the shell 4 on a wall of the chamber 30.

The puzzle may be arranged so as to be turned on by depressing a particular button designated as an on/off button, or by simultaneously depressing oppositely disposed buttons. The CPU is programmed so that when the puzzle is first operated, either a pre-determined or a random geometric pattern of lights is established. The user sequentially depresses buttons, which give rise to changes in the overall pattern of lights which are lit, in an attempt to achieve a particular desired overall pattern of lights. For example, in one game it is an object to reach a condition where all the lights are on. The CPU is programmed to produce a random pattern of lights when the puzzle is first switched on. As a particular button is depressed, the light associated with that button and the surrounding five lights will reverse, so that if they were originally on they will turn off, and if originally off they will turn on. The user presses individual buttons in turn in an attempt to reach the desired condition in which all the lights are on. An auto-off facility may be provided to turn the puzzle off if no button is depressed for three minutes.

A variety of other games may be programmed in the CPU.

The puzzle is able to provide a variety of different games which are conceptually pleasing particularly owing to the overall spherical symmetry, and which despite the simplicity of individual switching operations are extremely challenging.

The invention now being fully described, it will be apparent to one of ordinary skill in the art that any changes and modifications can be made thereto without departing from the spirit or scope of the invention as set forth herein.

What is claimed is:

1. A puzzle comprising:

a substantially spherical housing;

a plurality of lights disposed over a surface of said housing, said plurality of lights being arranged so that, regardless of an orientation of said spherical housing, at least one light is located on a hemisphere of said housing that faces a user of said puzzle;

a plurality of switches selectively operable by the user and disposed over an outer surface of said housing; and control means operatively connected to said switches and to said lights for switching on or off a select one or more of said lights in response to operation of any one selected switch.

2. A puzzle according to claim 1, wherein said plurality of lights are evenly positioned over the surface of the housing.

3. A puzzle according to claim 1, wherein said plurality of lights comprise twelve lights evenly positioned over the surface of the housing.

4. A puzzle according to claim 1, wherein said plurality of lights each comprise a light emitting element, and each of said switches includes a region comprising a button depressible by a user to operate the switch and that is at least partly formed of light-translucent material, each said light emitting element being located beneath a respective button.

5. A puzzle according to claim 4, wherein each switch includes a generally cylindrical light-translucent actuator comprising an upper surface defining said button and lying generally co-incident with the surface of the spherical housing, and a lower region seated in a cylindrical socket to be movable with a degree of relative movement.

6. A puzzle according to claim 5, further comprising a contact switch positioned between the actuator and the cylindrical socket and being actuated by depressing the button.

7. A puzzle according to claim 4, wherein the light emitting element comprises a light emitting diode positioned within the button.

8. A puzzle according to claim 1, further comprising an audible indicator activatable in response to a signal from said control means.

9. A puzzle according to claim 1, wherein said control means comprises a microprocessor programmed to operate the lights to provide a predetermined game.

10. A puzzle comprising:

a housing having a three-dimensional shape, and having a surface divided into a plurality of regions;

a plurality of lights disposed over the surface of said housing, said plurality of lights being arranged so that, regardless of an orientation of said housing, at least one light is located on a region of said housing that faces a user of said puzzle;

a plurality of switches selectively operable by the user and disposed over an outer surface of said housing; and control means operatively connected to said switches and to said lights for switching on or off a select one or more of said lights in response to operation of any one selected switch.

* * * * *